US005103430A

United States Patent [19]

Jeter et al.

[11] Patent Number: 5,103,430

[45] Date of Patent: Apr. 7, 1992

[54] MUD PULSE PRESSURE SIGNAL GENERATOR

[75] Inventors: John D. Jeter, St. Martinville; Leon M. Earl, Carencro; Merlin P. Landry, Lafayette, all of La.

[73] Assignee: The Bob Fournet Company, Lafayette, La.

[21] Appl. No.: 607,678

[22] Filed: Nov. 1, 1990

[51] Int. Cl.[5] ..... G01V 1/40

[52] U.S. Cl. ..... 367/85; 367/83; 175/50; 251/282

[58] Field of Search ..... 367/83, 85; 175/50; 251/282; 33/306, 307

[56] References Cited

U.S. PATENT DOCUMENTS

| | | | |
|---|---|---|---|
| 3,065,416 | 3/1960 | Jeter | 367/83 |
| 3,739,331 | 6/1973 | Goddey et al. | 367/142 |
| 3,958,217 | 5/1976 | Spinnler | 367/83 |
| 4,742,489 | 5/1988 | Barron | 367/85 |
| 4,825,421 | 4/1989 | Jeter | 367/83 |
| 4,869,100 | 9/1989 | Birdwell | 367/85 |
| 4,875,659 | 10/1989 | Hafile et al. | 251/282 |
| 4,901,290 | 2/1990 | Feld et al. | 367/85 |
| 4,986,512 | 1/1991 | Tiefenthaler | 251/282 |

*Primary Examiner*—Nelson Moskowitz
*Attorney, Agent, or Firm*—John D. Jeter

[57] ABSTRACT

A downhole signal generating mud pulser has a poppet and orifice signal valve to variably resist the drilling fluid stream. The poppet is upstream of the orifice and is moved by a piston in fluid communication with opposite flow related sides of the signal valve such that more pressure drop across the valve applies more piston force to open the valve. The poppet is spring biased toward the orifice and the piston force and spring balance when a preselected operating pressure exists. A servo valve controls flow in a by-pass loop to apply additional pressure to the piston to create a signal pulse when open. The servo valve is urged closed by flow in the servo loop and the closing is retarded by a dashpot to determine signal duration. The servo valve is spring biased to open and is automatically latched closed by a latch that responds to a solenoid actuated to release the servo valve. Options include replacement of the dashpot timer with a second latch position which latches the servo valve open to cause a signal pulse, the duration of which is determined by the controlling instrument which acts to release the latch from both positions.

21 Claims, 2 Drawing Sheets

MUD PULSE PRESSURE SIGNAL GENERATOR

This invention pertains to Measurement While Drilling (MWD) signal generators for use downhole in rotary, drilling fluid conducting, drill strings suspended in wells. More specifically, the invention pertains to apparatus to respond to electrical signals from a downhole instrument to cause pressure change signals downhole, in the drilling fluid stream, for detection and decoding at the surface. The apparatus may be installed in the drill string or, by packaging alternatives, lowered from the surface, through the drill string bore, to a prepared downhole location.

BACKGROUND OF THE INVENTION

Since the early days of rotary drilling it has been desirable to know what is happening in the downhole location to drilling assemblies, and to the course of the well bore, before running surveys and tripping the drill string. There have been many efforts to contrive apparatus to send information upward through the drilling fluid flowing in the drill string bore. U.S. Pat. No. 3,065,416 issued in November, 1962, was an early use of the drilling fluid to power the signalling apparatus. That invention was a servo amplified, mud breathing, device used to determine the speed of a turbodrill while it was operating downhole. That apparatus, only slightly modified, is still in use for that purpose. Its repetition rate is too slow to satisfy the demand for higher data rates needed today.

Mud breathing apparatus depend upon some degree of mud conditioning not always present and reliable until recent years. In the intervening years, efforts were made to eliminate mud breathing for power to manipulate the signal valve. Notable among those efforts were apparatus using mud driven turbines driving generators to provide electric power to operate signal valves. Except for the signal valve elements, these apparatus were sealed and operated in an oil filled enclosure. Those systems are complex and costly to build and operate. If the installed systems fail downhole the drill string has to be tripped to accomplish repair and replacement.

More recent trends have been to provide apparatus that can be lowered, and recovered, through the drill string bore. Failures of the apparatus can then be addressed without tripping the drill string. Such apparatus are not of sufficient diameter to permit the use of mud driven electric generators and have to depend upon batteries carried by the general enclosure, usually referred to as a shuttle package. Available batteries will not last long enough if they have to power the signal valve. Interest was again directed to the servo valve controlled, mud breathing, signal valve operating systems. Time and effort, and better mud conditioning processes, have brought more reliability to those contrivances. With greater reliability, and their inherent simplicity, mud breathers are again being used even when installed rather than being shuttle packaged.

The U.S. Pat. No. 4,724,498 issued May, 1988, represents a more recent design of mud breathing, servo controlled, systems.

Two paramount problems have to be recognized in mud breathing signal valve actuators. Erosion by abrasive, high velocity, drilling mud tends to degrade all machine parts exposed to the effluent from the signal valve, and fine particle silting tends to paralyze moving parts exposed to mud in quiescent regions of the machinery.

NATURE OF SIGNALS

Signals produced in the drilling fluid stream in MWD practice are generally referred to as pulses. In the signal valves used there are two changes of state in production of pulses. The two states are usually referred to as closed or open. Only if the signal valve restricts a bypass channel of the main mud stream does it ever close. A valve that operates to restrict the main stream approaches closure to increase restriction to cause a pressure increase. That action is referred to as on-pulse, or first state. When the valve is moved to reduce resistance to flow it is the off-pulse, or second state. Usually, the off-pulse state is the normal condition, and the condition that exists when a signal generator is not active. Change-of-state can in itself be used as a valid signal, whether the action increases or decreases resistance to flow. In the true pulse type signal, there is an increase in resistance followed, in time, by a decrease in resistance. The pulser of this invention can be used either as a change-of-state signal generator or a true pulse generator. In one sense the pulser is only a tool used by the downhole instrument exercising control to convert electrical to fluid pressure signals. In the pulser configuration usable as a change-of-state signal generator, the downhole instrument will define which signal system is used. In even a single data string of signals, the two forms of signals can be intermingled. In cases of detailed description of apparatus functions a distinction will be made between the forms of pressure changes being generated by the function.

It is therefore an object of this invention to provide a signal valve actuator and control system that is entirely situated above the signal valve and its high velocity mud effluent.

It is still another object of this invention to provide a signal valve operating system that requires no signal or control from the downhole instrument to generate a first pulse to provide power to be stored for the subsequent, controlled, pulse generation and to use each pulse generated thereafter to power the next pulse.

It is still a further object of this invention to provide pulse duration timing without further use of electric power after the signal from the downhole instrument to produce a pulse.

It is yet another object of this invention to provide a latch to secure the off-pulse state against accidental actuation of the latch by acceleration and shock present during drilling.

These and other objects, advantages, and features of this invention will be apparent to those skilled in the art from a consideration of this specification, including the attached claims and appended drawings.

SUMMARY OF THE INVENTION

A downhole mud pressure signal generator has an orifice and poppet signal valve with the poppet upstream of the orifice. The poppet is tubular, opening at the lower end toward the orifice. The poppet extends upward into a cylinder in the drill string and is attached to a piston for movement toward and away from the orifice. A first fluid channel conducts drilling fluid from above the orifice into the cylinder below the piston. A second fluid channel extends along the bore of the poppet, through a throttle orifice in the piston and into the cylinder above the piston. A third fluid channel conducts drilling fluid from above the orifice into a control housing, through a servo orifice and into the cylinder above the piston. A spring in the cylinder urges the poppet toward the orifice to produce an operating pressure drop across the orifice when drilling fluid is flowing. A servo poppet is situated above the servo orifice and supported to move relative to the servo orifice to function as a servo valve in the third channel.

When the servo valve is closed only the first and second channels supply pressure to opposite sides of the piston. The pressure drop across the orifice is delivered as a pressure differential across the piston and urges it to oppose the spring and open the signal valve until the operating pressure needed to balance the piston force and the spring force is established. That pressure is the operating pressure to set the system in motion in response to a signal from the downhole instrument.

When the servo valve is opened the operating pressure causes flow through the servo loop including channels one and three with their control orifices in series, with the cylinder, above the piston, receiving pressure between the servo and throttle orifices. The pressure above the piston is increased, reducing the pressure differential across the piston and the poppet moves down toward the orifice until the increased pressure drop across the signal valve rebalances piston and spring forces to establishes the signal pressure amplitude.

The servo poppet is on an operating stem that extends to a latch arranged to automatically latch the servo closed when it reaches closure. To close the servo, a cocking piston surrounds and slides on the stem and acts as a sail in the third channel. When fluid flows in the third channel the cocking piston compresses a cocking spring that will urge the servo poppet to the closed position when the stem is free to move it to that position. The servo valve must stay open until enough energy is invested in the increased signal pressure to carry it to the surface with sufficient energy surviving for detection. To delay closure of the servo valve a dashpot is used. A dashpot piston is secured to the stem and operates in a cooperating dashpot cylinder in the drill string. The dashpot is check valved to allow the dashpot piston, stem, and servo poppet to rise rapidly but move down slowly under dashpot control. The dashpot piston is ported to become free of restraint after a preselected amount of travel, or time. Once the dashpot piston moves freely the cocking spring moves the stem rapidly to the closed position and the latch secures the stem.

The stem latch is an expandable collet with lugs projecting inwardly to engage a peripheral groove around the stem. The collet is shaped to spring load the lugs into the groove and, hence, latches the stem automatically in the down, or servo valve closed, position. The collet has a conical end opening upward such that each lug has an associated lifting cam. A solenoid armature carries a conical cam that engages the conical cams on each lug when the solenoid is actuated and lifts the lugs out of the groove to release the stem. A stem return spring is situated to urge the stem upward. When the stem moves upward to open the servo valve, fluid flow begins in the third channel and the cocking piston moves down to compress the cocking spring. The cocking spring is stronger than the stem return spring and the stem, once free of dashpot control moves to close the servo valve and latch the stem. The solenoid is actuated only briefly and only once for each signal pulse generated in the drilling fluid stream.

To avoid accidental servo poppet release a restraint thimble is carried by the solenoid armature to rest peripherally around the collet cams to secure the lugs in the groove. The armature has some free travel before camming the lugs out of the groove and that travel carries the thimble past the collet cams, into a radial clearance between thimble and collet to allow the lugs to expand to release the stem.

As a design option, the stem has two axially spaced peripheral grooves. One groove latches the stem with the servo poppet in the closed position and the other groove latches the stem with the servo poppet in the open position. The dashpot is omitted and the solenoid actuation timing, under control of the downhole instrument, defines the on-pulse duration. By actions previously described, the stem is urged to move to the alternate position from whatever position it occupies when latched.

BRIEF DESCRIPTION OF DRAWINGS

In the drawings wherein like features have similar captions.

DETAILED DESCRIPTION OF DRAWINGS

Figure 1:
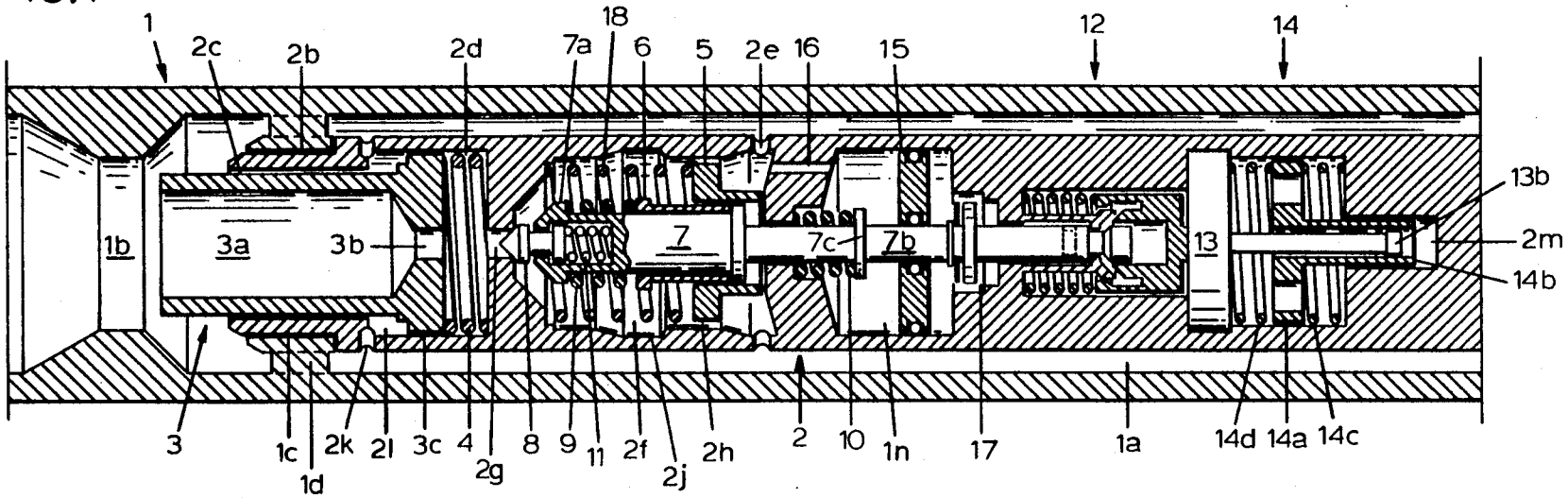
FIG. 1 is a side elevation, mostly cut away, of the preferred embodiment of the invention.

In the drawings many details pertaining to fabrication and maintenance utility well established in the machine construction art and not bearing upon points of novelty are omitted in the interest of descriptive clarity and efficiency. Such details may include threaded connections, lockrings, shear pins, weld lines and the like. The spreading use of electron beam welding eliminates many such features and leaves no visible distinctive lines. Oil filling and vent ports are not shown and wiring galleries for such as solenoids are essential to overall function but are matters of designers choice, are not claimed and, hence, not shown.

Figure 2:
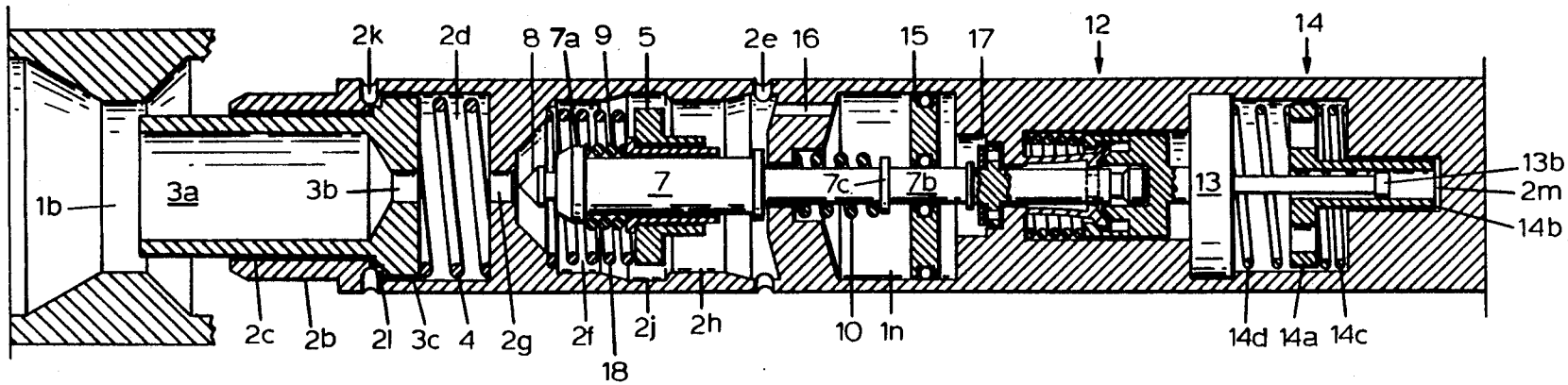
FIG. 2 is identical to FIG. 1 with the movable elements shown in alternate positions.

In FIGS. 1 and 2 the scale does not admit details of construction of a dashpot and a latching system. Those features will be shown later, rather enlarged, and will for these figures be functionally described.

A drill string component 1 has a general opening 1*a* to accept the pulser body 2 with room thereabout for annular flow of a stream of drilling fluid. A flow restriction, or orifice, 1*b* accepts the drilling fluid stream with a variable flow resistance determined by the position of poppet 3 which is carried by the body in bore 2*c* for movement toward and away from the orifice. As used in a well, upward is to the right on the drawing. Drilling fluid flows downward to the left.

In FIG. 1, the servo valve, consisting of servo orifice 2*g* and servo poppet 8, is closed and the system is in the off-pulse state. In that state the poppet 3 assumes a position determined by spring 4 and piston 3*c*, which operates in cylinder 2*d*. Drilling fluid from upstream of the orifice enters ports 2*k* to act on the annular area 21 below the piston. Drilling fluid from the open lower end of the poppet enters bore 3*a*, passes through control orifice 3*b*, and acts in cylinder 2*d* on the upper side of the piston. This produces a pressure drop across the orifice needed to activate the pulser when the servo valve is opened. The operating pressure is usually between ten and forty psi. The servo poppet is positioned by control rod 7*b* which is shown latched downward by latch 12. Solenoid 13 actuates the latch and the solenoid is actuated by an electric signal from a downhole instrument (not shown) which is part of the downhole assembly used by pulsers in the art.

When the solenoid 13 is actuated the latch is released, the control rod 7*b* is urged upward by spring 10 and lifts the servo poppet clear of the servo orifice 2*g* as shown in FIG. 2. Servo poppet carrier 7 is attached to the control rod and carries servo poppet 8, spring loaded downward by spring 11, for limited up and down travel relative to the carrier. Spring loading reduces the precision needed between the latch and the servo orifice.

With the servo valve open, fluid is urged through the servo loop, comprising openings 2*e* for fluid from upstream of the orifice, servo chamber 2*f*, and servo orifice 2*g*. The operating pressure causes flow through the servo loop and the pressure drops primarily through the servo orifice 2*g* and the control orifice 3*b*. The fluid pressure in cylinder 2*d* increases and the poppet piston 3*c* moves down until the pressure drop through orifice 1*b* is such that the upward piston force balances the spring force from spring 4. The pressure increase is the signal pressure amplitude which travels to the surface, somewhat reduced in transit, for detection at the earth surface.

Fluid flow through the servo loop entrains cocking piston 5 and moves it downward. The cocking piston moves some distance on sleeve 6, eventually engages a flange on the sleeve and the piston and sleeve continue downward to compress cocking spring 9. Cocking spring 9 is weaker than return spring 10 before being compressed by the sleeve but is stronger than spring 10 when compressed. The free travel of the cocking piston allows the cocking piston to start moving down while the control rod is still moving upward after opening the servo valve. Return spring 10 is allowed to move the control rod fully upward to push the dashpot piston into the bore of the dashpot 17 which is more fully described later. The dashpot has a check valve which permits its piston to be moved rapidly upward but damps the downward movement of the control rod to which it is secured.

The cocking piston 5 starts moving downward while it is in choke bore 2*h* which adds speed to its movement. When the cocking piston reaches relief bore 2*j*, the added flow area reduces the entrainment force and it stops moving. Spring 18 opposes downward movement of the cocking piston and returns it to the starting position when the servo valve is closed. The cocking piston will stay in the downward position as long as fluid flows through the servo loop and spring 9 is capable of moving the control rod down to the latch position when the dashpot piston reaches a position for porting to terminate the damping effect.

The dashpot is sized to oppose the downward force on the control rod, allowing slow movement, until the preselected duration of the on-pulse state is accomplished. The control rod then moves rapidly down to close the servo valve and allow the latch to secure the control rod in the off-pulse state.

When the servo valve is closed no flow exists in the servo loop and cocking piston 5 is urged back up to the starting position by spring 18. Spring 9 urges the sleeve 6 back to its upper travel limit determined by a flange on the carrier 7. The system is reset to produce another pulse when the solenoid again releases the control rod.

With the servo valve closed poppet 3 returns to the original position to produce only operating pressure drop across the orifice.

Piston 15, sealingly slidable in bore 1*n*, is a separator between oil above and mud below and serves as a hydrostatic compensator.

The fluid pressure in bore 3*a* approximates the pressure below orifice 1*b* because the velocity of fluid moving through the orifice is established just below the end of the poppet and, except for orifice efficiency, the velocity head equals the pressure drop across the orifice.

The pulser body 2 may be installed in the drill string bore but is well adapted for use as a shuttle body to be lowered through the drill string bore to the downhole location. If used as a shuttle body, the landing baffle has bore 1*c* supported on fins 1*d* and may include the conventional muleshoe arrangement well established in the art to rotationally orient the body relative to the drill string. Such systems are well known to those skilled in the art and it is not shown in detail. If the shuttle system is used, the body 2 will continue upward to contain power supply batteries and a downhole instrument to sense downhole parameters to be transmitted to the surface. There is usually an upper stabilizer and an overshot spear to recover the shuttle body without tripping the drill string. Whether installed at the surface or lowered later into the drill string bore, the pulser body is considered herein to be part of the drill string once it is in the downhole location.

Acceleration compensator 14 is the subject of copending U.S. patent application 492,901 filed 03/12/90. This arrangement provides for free movement of the solenoid armature as a result of force applied to the armature but prevents acceleration along the direction of armature motion causing that force. The mass 14*a* weighs about the same as all elements attached to, for movement with, the armature. If the body is accelerated along the drill string axis the mass resists acceleration and applies the resulting force to annular piston 14*b* operating in cylinder 2*m*. A hydraulic pressure is created and acts in the cylinder on piston 13*b* to accelerate it in the direction of acceleration of the drill string. The active areas of pistons 14*b* and 13*b* are the same. If the solenoid applies a force to the armature, that force unbalances the forces on the pistons and the armature will move without being influenced by the acceleration of the body. The pistons are not tightly fitted and by-pass fluid reduces friction. Springs 14*c* and 14*d* slowly centralize the mass, which has no piston effect. Significant acceleration forces on the body are shock and vibration induced and are of small amplitude and duration. The mass freely oscillates about a neutral position.

Vent 16 allows mud to flow into and from bore 1*n* so that piston 15 can freely move to equalize mud and oil pressure.

Figure 3:
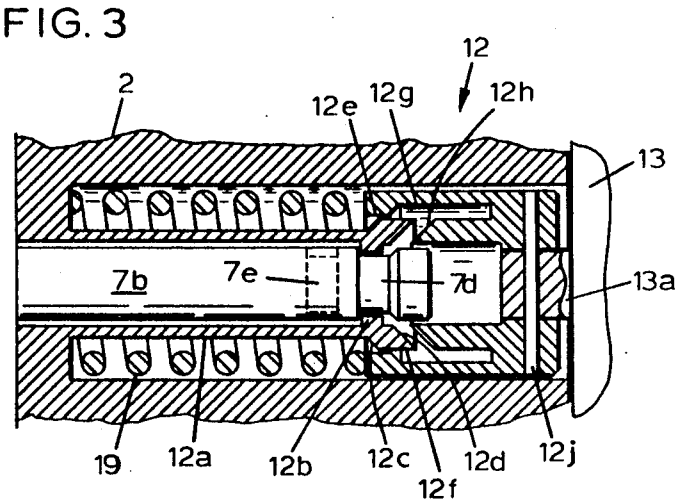
FIG. 3 is a selected portion of the apparatus of FIG. 1 rather enlarged, to show details of a latch means.

FIG. 3 is a somewhat enlarged view of the latch of FIGS. 1 and 2. For convenience a latch collet, formed of twelve spring bars 12*a* distributed peripherally about control rod 7*b*, is shown as part of body 2. The collet as used is a removable part secured to the body and becomes a structural part by the rigid connection. Each spring bar 12*a* has an enlarged end forming latch lug 12*b*, cam 12*d*, cam 12*c*, and surface 12*f*. The spring bars are machined to the shape shown and latch into groove 7*d* of the control rod automatically. The control rod is biased upward, to the right, and is held down by the latching action. Solenoid is secured to the body and has an armature that moves rod 13*a* down to the left when the solenoid is actuated from the rest position shown. Pin 12*j* secures the cam unit to rod 13*a*. Spring 19 urges the cam unit, and the connected solenoid rod and armature to the right and cylindrical restraint surface 12*e* is positioned radially outward of surface 12*f* to hold the latch lugs 12*b* in the latch groove 7*d* to prevent lateral vibration and shock from working the latch loose before the solenoid is actuated. The cams 12*h* will move cams 12*d* to open the latch and release the control rod, but there is some travel distance before that action and that distance moves surface 12*e* leftward from surfaces 12*f* and allows the latch to open.

Figure 4:
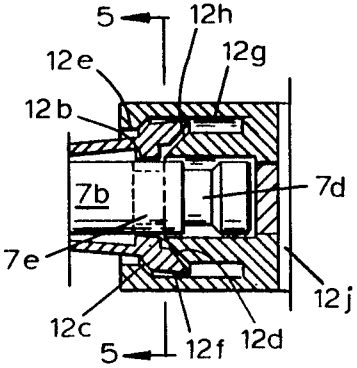
FIG. 4 is a selected portion of the apparatus of FIG. 3 to show movable elements in alternate positions.

In FIG. 4 the solenoid has actuated and moved the cam unit down to release the latch. The released control rod has moved upward. Before cam 12*h* engaged cam 12*d*, surface 12*e* had cleared surface 12*f*. If vibration had released the latch before cams lifted the lugs the timing error would not have been detectable at the surface and no error would result. Further movement of the cam unit causes cam 12*h* to lift cams 12*d* and the collet expands into the relief 12*g*. After the control rod moves upward the collet cannot restore itself until the rod is moved back down by the cocking spring as previously described because lugs 12*b* ride on the rod surface. Spring 19 cannot move the cam unit back up because the cam surface 12*c*, is still in the relief 12*g*. During the time the dashpot delays downward movement of the control rod the actuating current to the solenoid is turned off by the downhole instrument. When the control rod moves down the lugs move back into groove 7*d* by spring bar natural shape, the cam unit moves upward, and the lugs are again confined in the groove by surface 12*e*. The latch is reset and ready to be released to cause the next signal pulse.

Figure 5:
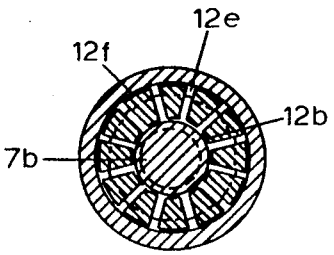
FIG. 5 is a sectional view of the apparatus of FIG. 4, taken along line 5—5.

FIG. 5 is a sectional view of FIG. 4 taken along line 5—5. Dotted lines show the position of collet surfaces when latched.

Figure 7:
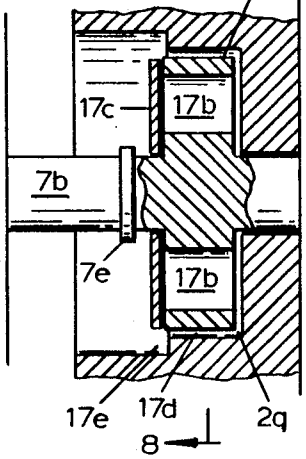
FIG. 7 is identical to FIG. 6 showing movable elements in alternate positions. 33
Figure 6:
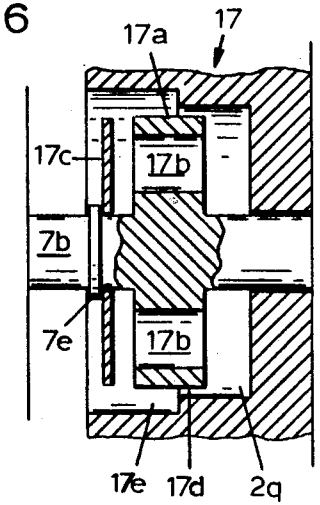
FIG. 6 is a selected portion of FIG. 1, somewhat enlarged, to show dashpot details.

In FIG. 6 the dashpot 17 is shown with rod 7*b* down in the latched position. When the rod is released it starts upward, moving piston 17*a* into dashpot bore 2*q*. Oil flows freely out ports 17*b* around check valve washer 17*c*. Washer 17*c* can move down on the rod only far enough to be stopped by flange 7*e*. The radial clearance 17*d* between piston and bore is somewhat exaggerated. Vent bore 17*e* vents fluid from the dashpot to release the piston from dashpot effect after a preselected amount of travel downward from the most upward position shown in FIG. 7. The vent releases the piston for rapid travel downward while some available downward travel of the control rod remains. The speed of rod travel assures that the control rod goes down to latch even after the servo poppet has begun to throttle fluid flow through the servo orifice.

Figure 8:
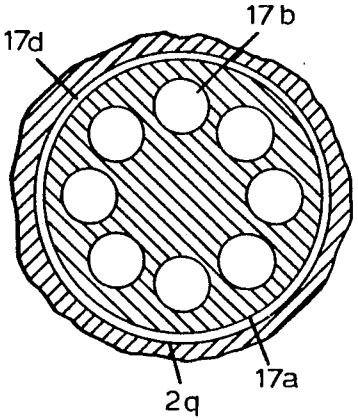
FIG. 8 is a sectional view of the apparatus of FIG. 7, taken along line 8—8.

FIG. 8 shows the piston and ports, again with the radial clearance 17*d* exaggerated.

As a design option, the dashpot can be eliminated and peripheral groove 7*e* can be added to the control rod in such position that groove 7*e* is in registry with lugs 12*b* when the servo valve is open. The timing of the release of the control rod will then be determined by the downhole instrument because the solenoid will have to be actuated each time the servo valve moves to change the state of the pressure signal in the mud stream. The solenoid is only actuated briefly to release the latch and the spring bars automatically urge the lugs into the grooves each time a groove is in registry. As long as the servo valve is open the cocking piston is downward urging the servo valve closed. Either the open or closed state can be held indefinitely and the pulser is suitable for change-of-state signal encoding.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

We claim:

1. Apparatus for creating pressure pulse signals in a stream of drilling fluid being circulated through a drill string, the apparatus comprising: a restriction in the drill string, a valve member located above the restriction and arranged for movement toward and away from the restriction to perform a signal valve function, a cylinder located in the drill string above the restriction, a valve stem connected to the valve member and extending into the cylinder, a piston located in the cylinder and connected to the valve stem, a first spring arranged to urge the valve member toward the restriction, first passage means arranged to conduct drilling fluid upstream of the restriction into the cylinder to act against the piston to urge it upward to move the member away from the restriction, second restricted passage means arranged to conduct drilling fluid from below the lower end of the valve member into the cylinder to act above the piston to provide a pressure differential across the piston proportional to the pressure drop across the restriction to urge it upward to provide an operational pressure drop across the restriction proportional to the force of the first spring, third restricted passage means arranged to conduct drilling fluid above the restriction into the cylinder above the piston to urge it downward to increase flow resistance through the restriction, servo valve means arranged to open and close the third passage so that when the third passage is closed the first spring and the piston effective area determine the pressure drop across the restriction and, when open, the ratio of flow areas for the restrictions in the second and third restricted passage means determines the pressure increase in the cylinder urging the piston and valve member toward the restriction to create and limit a signal pressure increase across the restriction, the servo valve actuated by a control stem which is biased by a second spring to urge the servo valve open, the control stem connected to a control piston situated in the third passage and arranged to be moved by entrainment when fluid flows through the third passage, the control piston arranged to urge the control stem to move the servo valve closed when the control piston is moved a preselected amount by fluid flow, latch means arranged to automatically engage and releasably latch the control stem in the servo valve closed position, solenoid means arranged to release the latch means in response to an electric signal from a downhole instrument to create a signal pressure change at the restriction, and dashpot means on the control stem to determine the time required for the control piston to move the servo valve closed, once the servo valve is opened, to establish a preselected amount of time the signal pressure increase is retained.

2. The apparatus of claim 1 wherein the first spring is situated in the cylinder to act against the piston.

3. The apparatus of claim 1 wherein said latch means comprises a peripheral groove around the stem and a cooperating latch collet having at least one spring bar with a lug to engage the groove and a cam surface to lift the lug out of the groove when engaged by a lifting cam actuated by the solenoid.

4. The apparatus of claim 1 wherein a third spring is arranged such that the control piston applies a resilient closing force to the servo valve, the third spring being weaker than the second spring before being compressed by movement of the control piston in response to flow in the third passage means and being stronger than the second spring after the control piston is moved a preselected amount by flow in the third restricted passage means.

5. The apparatus of claim 1 wherein a fourth spring is arranged to urge the control piston in a direction opposite the flow in the third restricted passage means to move it to a preselected starting position while the servo valve is closed and the control piston is arranged to move a preselected amount in the direction of flow in the third restricted passage means before applying a closing force to the servo valve.

6. The apparatus of claim 1 wherein the servo valve comprises a servo poppet arranged to cooperate with an orifice providing the restriction in the restricted third passage means.

7. The apparatus of claim 1 wherein said dashpot comprises a dashpot piston attached to the servo valve stem to move in a cooperating dashpot bore in the drill string, the dashpot piston having a check valve to permit fluid to freely flow from the dashpot bore to allow the stem to move rapidly when opening the servo valve and close to prevent fluid flow therethrough from the dashpot bore, a flow restriction arranged to allow fluid to flow into the dashpot bore at a preselected rate to control the time required for the dashpot to allow the servo valve stem to move to close the servo valve.

8. The apparatus of claim 3 wherein the spring bar has a restraining surface and the lifting cam has a cooperating confining surface attached to the lifting cam arranged to radially confine the lug in the peripheral groove until the lifting cam is moved a preselected amount toward the cam surface to prevent vibration and shock forces from dislodging the lug from the groove.

9. The apparatus of claim 1 wherein the second restricted passage means includes a tubular bore through the valve member, opening at the lower end thereof, extending through the stem, and through a restriction in the piston to open into the cylinder whereby the drilling fluid accelerated for passage through the restriction at the lower end of the valve member produces a static fluid pressure, proportional to the fluid pressure below the restriction, in the second restricted passage means.

10. The apparatus of claim 1 wherein the restriction is installed in the drill string near a landing baffle and the rest of the apparatus is contained in a shuttle package that may be lowered through the drill string bore to be located downhole by the landing baffle such that the valve member cooperates with the restriction to perform the signal valve function.

11. The apparatus of claim 10 wherein the landing baffle and the shuttle package have a cooperating muleshoe arrangement to rotationally orient the shuttle package relative to the drill string.

12. Apparatus for creating pressure pulse signals in a stream of drilling fluid being circulated through a drill string, the apparatus comprising: a restriction in the drill string, a valve member located above the restriction, and arranged for movement toward and away from the restriction to perform a signal valve function, a cylinder located in the drill string above the restriction, a valve stem connected to the valve member and extending into the cylinder, a piston located in the cylinder and connected to the valve stem, a first spring arranged to urge the valve member toward the restriction, first passage means arranged to conduct drilling fluid upstream of the restriction into the cylinder to act against the piston to urge it upward to move the member away from the restriction, second restricted passage means arranged to conduct drilling fluid from below the lower end of the valve member into the cylinder to act above the piston to provide a pressure differential across the piston proportional to the pressure drop across the restriction to urge it upward to provide an operational pressure drop across the restriction proportional to the force of the first spring, third restricted passage means arranged to conduct drilling fluid above the restriction into the cylinder above the piston to urge it downward to increase flow resistance through the restriction, servo valve means arranged to open and close the third passage so that when the third passage is closed the first spring and the piston effective area determine the pressure drop across the restriction and, when open, the ratio of flow areas for the restrictions in the second and third restricted passage means determines the pressure increase in the cylinder urging the piston and valve member toward the restriction to create and limit a signal pressure increase across the restriction, the servo valve actuated by a control stem which is biased by a second spring to urge the servo valve open, the control stem connected to a control piston situated in the third passage and arranged to be moved by entrainment when fluid flows through the third passage, the control piston arranged to urge the control stem to move the servo valve closed when the control piston is moved a preselected amount by fluid flow, latch means arranged to automatically engage and releasably latch the control stem in the servo valve closed and in the servo valve open positions when the servo valve arrives at either of those positions, solenoid means arranged to release the latch means in response to an electric signal from a downhole instrument to create a signal pressure change at the restriction.

13. The apparatus of claim 12 wherein the first spring is situated in the cylinder to act against the piston.

14. The apparatus of claim 12 wherein said latch means comprises peripheral grooves around the stem and a cooperating latch collet having at least one spring bar with a lug to engage the groove and a cam surface to lift the lug out of the groove when engaged by a lifting cam actuated by the solenoid.

15. The apparatus of claim 12 wherein a third spring is arranged such that the control piston applies a resilient closing force to the servo valve, the third spring being weaker than the second spring before being compressed by movement of the control piston in response to flow in the third passage means and being stronger than the second spring after the control piston is moved a preselected amount by flow in the third restricted passage means.

16. The apparatus of claim 12 wherein a fourth spring is arranged to urge the control piston in a direction opposite the flow in the third restricted passage means to move it to a preselected starting position while the servo valve is closed and the control piston is arranged to move a preselected amount in the direction of flow in the third restricted passage means before applying a closing force to the servo valve.

17. The apparatus of claim 12 wherein the servo valve comprised a servo poppet arranged to cooperate with an orifice providing the restriction in the restricted third

18. The apparatus of claim 14 wherein the spring bar has a restraining surface and the lifting cam has a confining surface attached to the lifting cam to radially confine the lug in the peripheral groove until the lifting cam is moved a preselected amount toward the cam surface to prevent vibration and shock forces from dislodging the lug from the groove.

19. The apparatus of claim 12 wherein said second restricted passage means includes a tubular bore through the valve member, opening at the lower end thereof, extending through the stem, and through a flow restriction in the piston to open into the cylinder whereby the drilling fluid accelerated for passage through the restriction at the lower end of the member produces static fluid pressure proportional to the fluid pressure below the restriction in the second restricted passage means.

20. The apparatus of claim 12 wherein the restriction is installed in the drill string near a landing baffle and the rest of the pulser is contained in a shuttle package that may be lowered through the drill string bore to be located by the landing baffle such that the valve member cooperates with the restriction to perform the signal valve function.

21. The apparatus of claim 20 wherein the landing baffle and the shuttle package have cooperating muleshoe arrangements to rotationally orient the shuttle package relative to the drill string.

* * * * *